United States Patent [19]

Schollenberger

[11] Patent Number: 4,688,483

[45] Date of Patent: Aug. 25, 1987

[54] CLAMPING DEVICE FOR A PRINTING PLATE OF AN OFFSET PRINTING MACHINE

[75] Inventor: Heinz Schollenberger, Leimen, Fed. Rep. of Germany

[73] Assignee: Heidelberger Druckmaschinen AG, Heidelberg, Fed. Rep. of Germany

[21] Appl. No.: 712,367

[22] Filed: Mar. 15, 1985

[30] Foreign Application Priority Data

Mar. 15, 1984 [DE] Fed. Rep. of Germany ..... 3409479

[51] Int. Cl.[4] ..... B41F 1/28

[52] U.S. Cl. ..... 101/415.1; 101/378; 101/383; 101/407 A; 403/408.1

[58] Field of Search ..... 101/415.1, 378, 382 R, 101/383, 395, 407 A, DIG. 12; 403/408.1

[56] References Cited

U.S. PATENT DOCUMENTS

| | | | |
|---|---|---|---|
| 2,737,887 | 3/1956 | Gericke | 101/415.1 |
| 3,112,698 | 12/1963 | Lake | 101/415.1 |
| 3,168,040 | 2/1965 | Norton | 101/415.1 |
| 4,459,913 | 7/1984 | Kowalik | 101/415.1 |

FOREIGN PATENT DOCUMENTS

| | | | |
|---|---|---|---|
| 154843 | 9/1985 | European Pat. Off. | 101/415.1 |
| 1082639 | 9/1967 | United Kingdom | 101/415.1 |

*Primary Examiner*—Edgar S. Burr
*Assistant Examiner*—Moshe I. Cohen
*Attorney, Agent, or Firm*—Herbert L. Lerner; Laurence A. Greenberg

[57] ABSTRACT

A clamping device for a printing plate mountable on a plate cylinder of an offset printing machine and having perforations formed at leading and trailing edges thereof, as viewed in direction of sheet travel through the machine, the clamping device includes clamping bars formed with hooks respectively engageable in the perforations formed in the printing plates, the clamping bars being disposed in a channel formed in the plate cylinder, one of the clamping bars being pivotable about a pivot point diagonally to a longitudinal direction of the plate cylinder, the pivot point being located in the cylinder channel substantially on a center line of the cylinder extending transversely to the longitudinal direction thereof, and adjusting means mounted in the cylinder channel for moving another one of the clamping bars in the longitudinal direction of the cylinder, the other clamping bar having additional degrees of freedom of movement accommodating an accompanying diagonal movement which respect to the longitudinal direction of the cylinder and a clamping movement in circumferential direction of the cylinder.

7 Claims, 6 Drawing Figures

CLAMPING DEVICE FOR A PRINTING PLATE OF AN OFFSET PRINTING MACHINE

The invention relates to a clamping device for a printing plate mountable on a plate cylinder of an offset printing machine and having perforations at leading and trailing edges thereof as viewed in direction of sheet travel through the machine. Clamping bars are associated with the perforations, the clamping bars being provided with hooks and being arranged in the channel of the plate cylinder, one of the clamping bars being pivotable about a pivot point diagonally with respect to the longitudinal direction of the cylinder.

On small offset printing presses, the printing plates for mounting on the plate cylinder are generally provided in the form of a foil and are given those characteristics which are required for the offset process by means of an etching device.

Two different procedures are customary for fastening these printing plates. First, it is possible to present the printing plates to the plate cylinder by means of a drawing-in feeding device, where they may then be secured to the plate cylinder by the leading edge thereof by means of a clamping device while the trailing edge thereof lies freely on the cylindrical surface of the plate cylinder. In the other procedure, the plate cylinder is provided with clamping units in which clamping bars are fitted with hooks which engage in suitably provided perforations formed at the leading and trailing edges of the printing plate, and the printing plate is then tightened or stretched around the circumference of the cylinder.

To ensure that the paper sheets ate printed in accurate register and exactly at the correct place it is necessary to be able to move the printing plate adjustably both sideways as well as diagonally or transversely with respect to the longitudinal direction of the cylinder.

Clamping devices according to the state of the art are known which permit either only a lateral displacement of the printing plate or only a diagonal displacement in that one of the mountings of the clamping device for the leading edge of the printing plate is equipped on one side with an eccentric adjusting mechanism.

These heretofore known devices have proved disadvantageous in practice in that, on the one hand, the printing plate generally becomes skewed when being clamped in position and, on the other hand, the adjusting mechanism operates less smoothly as fouling increases, with the result that the perforations in the printing plate are torn out. Furthermore, such heretofore known devices are often awkward to handle, because the printing plate may have to be removed during the adjusting process.

It is accordingly an object of the invention to provide a plate-cylinder clamping mechanism for perforated printing plates, particularly for small offset printing presses, which is user friendly, tends not to be prone to build-up of dirt or fouling and, moreover, permits both lateral adjustment and diagonal or transverse adjustment with respect to the longitudinal direction of the cylinder.

With the foregoing and other objects in view, there is provided, in accordance with the invention, a clamping device for a printing plate mountable on a plate cylinder of an offset printing machine and having perforations formed at leading and trailing edges thereof, as viewed in direction of sheet travel through the machine, the clamping device comprising clamping bars formed with hooks respectively engageable in the perforations formed in the printing plates, the clamping bars being disposed in a channel formed in the plate cylinder, one of the clamping bars being pivotable about a pivot point diagonally to a longitudinal direction of the plate cylinder, the pivot point being located in the cylinder channel substantially on a center line of the cylinder extending transversely to the longitudinal direction thereof, and adjusting means mounted in the cylinder channel for moving another one of the clamping bars in the longitudinal direction of the cylinder, the other clamping bar having additional degrees of freedom of movement accommodating an accompanying diagonal movement which respect to the longitudinal direction of the cylinder and a clamping movement in circumferential direction of the cylinder.

In accordance with another feature of the invention, the degrees of freedom of the other clamping bar are composed of individual degrees of freedom of mutually connected components of the clamping device, the components being arranged on different levels.

In accordance with an added feature of the invention, there are provided respective clamping units for the leading edge and for the trailing edge of the printing plate, the clamping unit for the leading edge comprising a bottom metal sheet partially covering the channel of the cylinder, a threaded pin carried by the bottom metal sheet substantially on the center line of the cylinder, the threaded pin forming the pivot point for the one clamping bar, the one clamping bar being disposed on the bottom metal sheet.

In accordance with a further feature of the invention, the clamping bar is formed with beads at an underside thereof, said beads serving as spacers of the one clamping bar from the bottom metal sheet.

In accordance with an additional feature of the invention, the beads are spaced at regular intervals from one another.

In accordance with a further feature of the invention, there is provided a locking device secured to the one clamping bar for locking the clamping bar in axially-parallel position, the locking means comprising a T-shaped locking lever rotatably mounted on a strap of the one clamping bar, the locking lever having a shank engaging in a cutout formed in the bottom metal sheet.

In accordance with again another feature of the invention, the cutout formed in the bottom metal sheet has a narrow section and a broad section, the narrow cutout section being as broad as the shank of the T-shaped locking lever.

In accordance with again a further feature of the invention, there are provided respective clamping units for the leading edge and for the trailing edge of the printing plate, the clamping unit for the trailing edge comprising a bottom metal sheet disposed in and partly covering the cylinder channel, a lower rail and an upper rail thereabove arranged on the bottom metal plate, a metal pin mounted on the upper rail substantially on the center line of the plate cylinder, the metal pin connecting the upper rail with the other clamping bar.

In accordance with yet an added feature of the invention, both the lower and the upper rails are formed at the undersides thereof with beads as spacers.

In accordance with yet a further feature of the invention, the beads are mutually spaced at substantially regular intervals.

In accordance with again an additional feature of the invention, there are provided articulating points disposed within the plate cylinder and arranged symmetrically with respect to the plate cylinder, respective tension springs articulatingly connected at one end thereof, respectively, to the articulating points and holding a respective pin at the other end thereof, the pins, respectively, projecting through a slot formed in the bottom metal sheet and extending in circumferential direction of the cylinder, the pins being fastened to the lower rail, and including another pin engaging the lower rail and projecting through a slot formed in the upper rail and oriented in longitudinal direction of the cylinder.

In accordance with a concomitant feature of the invention, there is provided an eccentric having an adjusting lever and being connected to the lower rail via a threaded pin, the eccentric being disposed substantially at the center line of the plate cylinder, and projecting through a cutout formed in the upper rail for laterally shifting the upper rail.

Other features which are considered as characteristic for the invention are set forth in the appended claims.

Although the invention is illustrated and described herein as embodied in a clamping device for a printing plate of an offset printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
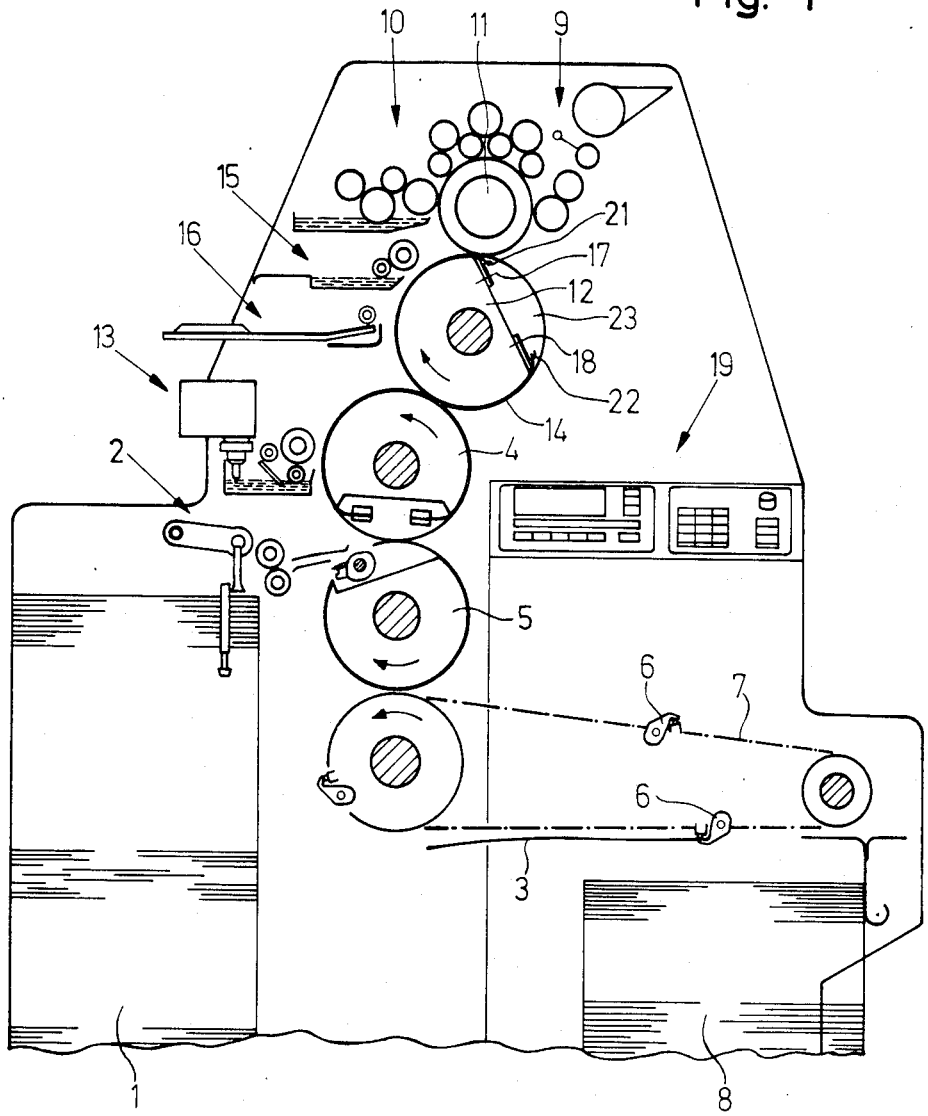
FIG. 1 is a diagrammatic side elevational view of a small offset printing press.

Referring now to the drawing and first, particularly, to FIG. 1 thereof, there is shown in a small offset printing press, individual paper sheets 3 which are fed from a paper stack 1 via a separator or isolating device 2 into a gap between a rubber or blanket cylinder 4 and an impression cylinder 5, where the printing process takes place. The thus printed paper sheet 3 is then taken over by a chain delivery unit 7 equipped with rows of grippers 6 and passed on to a delivery stack 8. The printing image is transferred via a dampening unit 9 and an inking unit 10 with an applicator roller 11, the applicator roller 11 inking a plate cylinder 12, from the plate cylinder 12 to the rubber or blanket cylinder 4, the rubber cylinder 4 then effecting the actual printing. The rubber or blanket cylinder 4 is associated with a rubber blanket washing device 13, whereas an etching device 15 is provided for the printing plate 14; in addition, the plate cylinder 12 can be associated with an infeed device 16.

The printing plate 14 is secured to the plate cylinder 12 by means of a clamping device 17 for the leading edge 21 of the printing plate 14, and a further clamping device 18 for the trailing edge 22 of the printing plate 14.

A control console 19 equipped with relevant keyboards serves for operating the machine.

Figure 2:
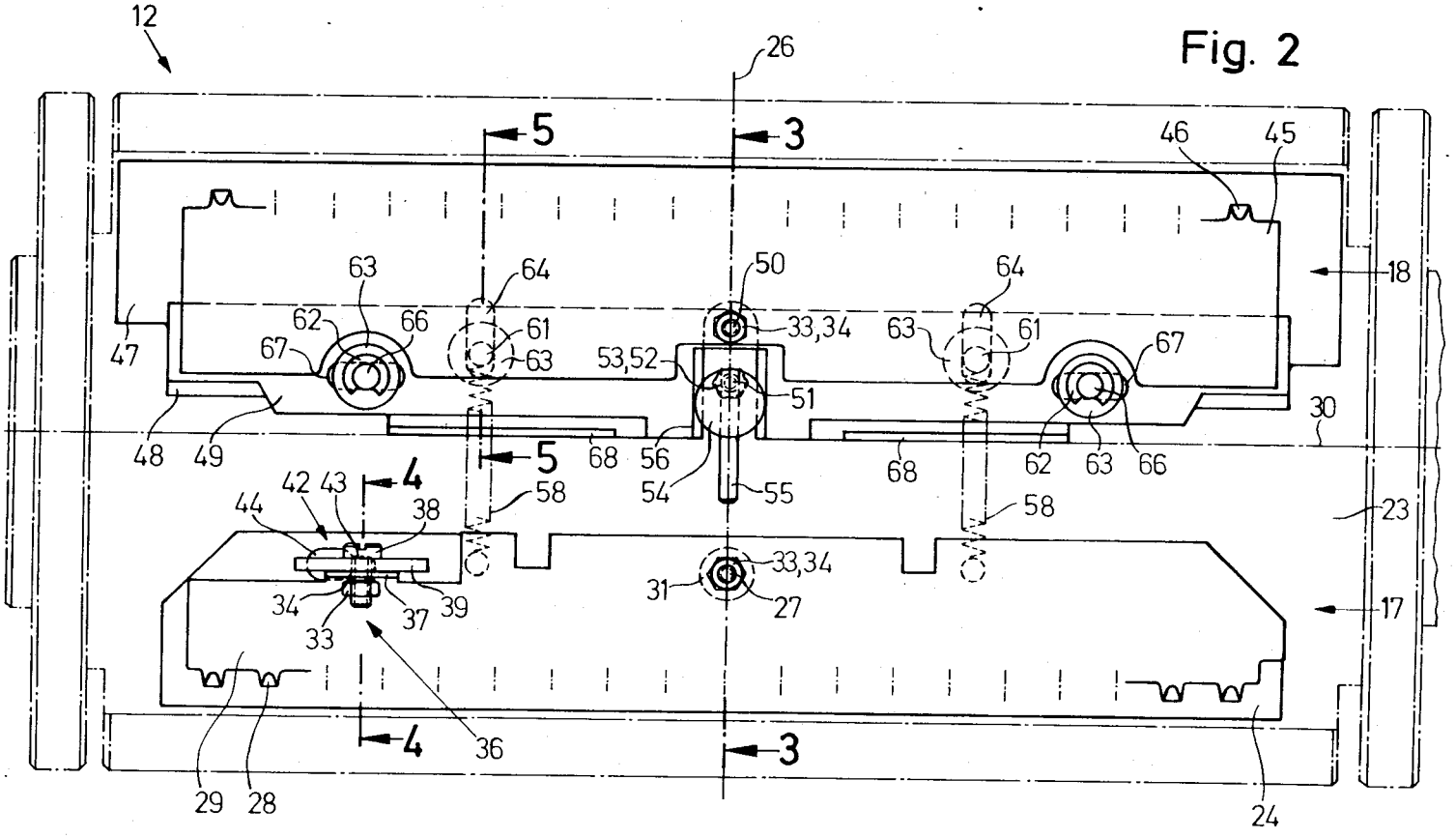
FIG. 2 is an enlarged plan view of the printing plate cylinder of FIG. 1 together with a clamping device constructed in accordance with the invention.

FIG. 2 is an enlarged view of the plate cylinder 12 with the clamping devices 17 and 18, the outlines or contours of the plate cylinder 12 and a plate-cylinder longitudinal axis 30 being indicated.

The clamping device 17 for the leading edge 21 of the printing plate 14 (FIG. 3) is formed initially of a bottom metal sheet 24 partially covering a cylinder channel 23 and connected to the plate cylinder 12 via screw connections 25. A threaded pin 27 projects from the surface of the bottom metal sheet 24 in the region of the plate-cylinder center-line 26, the threaded pin 27 serving as pivot point for a clamping bar 29 arranged on the bottom metal sheet 24 and provided with hooks 28.

The threaded pin 27 projecting through a bore 32 (FIG. 3) formed in the clamping bar 29 is provided at its upper end with a nut 33 with an appertaining locking washer 34 and an underlying disk 31 for holding the clamping bar 29. Beads 35 provided at preferably regular intervals on the underside of the clamping bar 29 and serving as spacer elements improve ease of movement and prevent excessive contamination or fouling.

Figure 4:
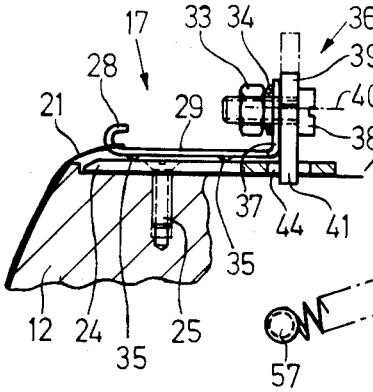
FIG. 4 is a cross-sectional view of FIG. 2 taken along the line 4—4 in direction of the arrows.

The clamping bar 29, which, in this manner, is movable diagonally with respect to the longitudinal direction of the plate cylinder 12, can be secured in an axially parallel position via a locking device 36 additionally arranged on the clamping bar 29. This arrangement facilitates, among other things, clamping of the printing plate 14. To this end, the clamping bar 29 has a web or strap 37 in this region in the form of a right-angled turned-up edge. A locking lever 39 (see also FIG. 4) is secured on the web or strap 37 by means of a bolt 38, a nut 33 and a locking washer 34.

Figure 6:
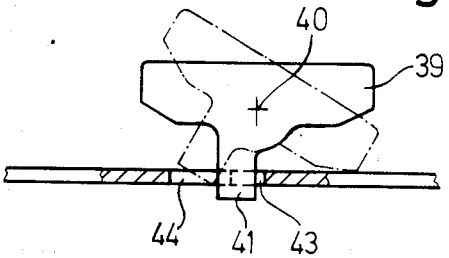
FIG. 6 is a front elevational view, partly in section, of FIG. 4 showing a locking lever according to the invention.

The locking lever 39 has a T-shaped construction and is pivotable about a pivot point 40, formed by a bolt 38, a shank or shaft 41 of the locking lever 39 engaging in a recess or cutout 42 formed in the bottom metal sheet 24, the cutout 42 being visible in FIG. 2, for example. The cutout 42, in turn, has a narrow section 43 and a wide section 44. In the position of the locking lever 39 shown in FIG. 6, the shank or shaft 41 engages in the narrow section 43 of the cutout 42, the narrow section 43 being dimensioned to the same width as that of the shank 41, and in so doing effectively locks the clamping bar 29 in an axially parallel orientation. In the position of the locking lever 39 shown in phantom, the locking effect thus produced is released and, due to the wide section 44 of the cutout 42, a given clearance is possible for rotary movement of the clamping bar 29 about the pivot point created by the threaded pin 27.

Figure 3:
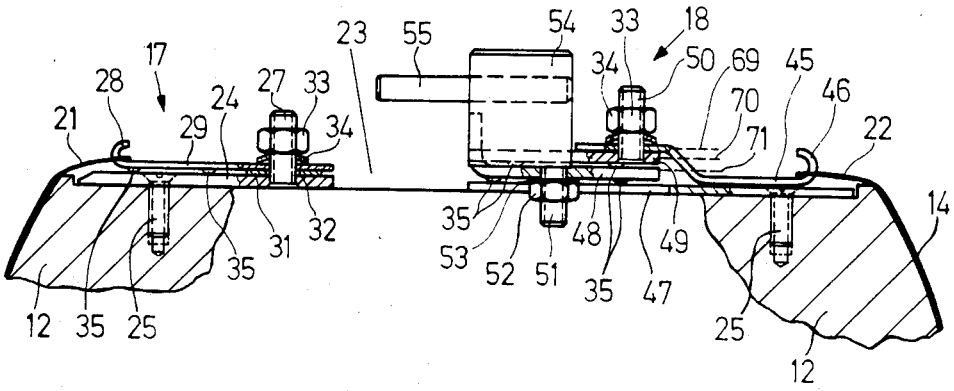
FIG. 3 is a cross-sectional view of FIG. 2 taken along the line 3—3 in direction of the arrows.
Figure 5:
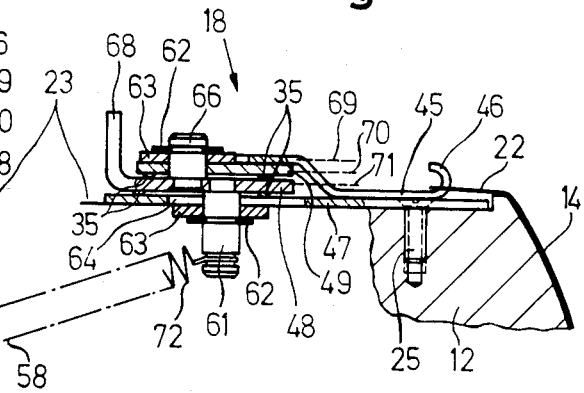
FIG. 5 is a cross-sectional view of FIG. 2 taken along the line 5—5 in direction of the arrows.

FIGS. 3 and 5 show views of the clamping device 18 for the trailing edge 22 of the printing plate 14 cooperating with the clamping device 17 for the leading edge 21 of the printing plate 14. The clamping device 18 is also provided with a clamping rail 45 having hooks 46.

FIG. 3 shows the adjusting mechanism for adjusting the clamping rail 45 laterally i.e. in the longitudinal direction of the cylinder. In this region of the cylinder channel 23, also, a bottom metal sheet 47 is provided partially covering the cylinder channel 23. On the bottom metal sheet 24, a lower rail 48 and, lying above the lower rail 48, an upper rail 49, are arranged, the lower and upper rails 48 and 49 being movable relative to one another, as will be explained hereinafter. A threaded pin 50 is provided on the upper rail 49 in the region of plate-cylinder centerline 26, the threaded pin 50 providing the connection with the clamping strip 45 via a nut 33 and a locking washer 34, mutual rotatability about the threaded pin 50 as axis of rotation being maintained, however. Beads 35 provided on both rails 48 and 49 also serve in this regard for ease of movement, and prevent excessive contamination.

An eccentric 54 is connected to the lower rail 48 via a threaded pin 51 with a nut 52 and a washer 53 and has an adjusting lever 55.

The eccentric 54 rotatable about the threaded pin 51 as pivot point, projects out of a cutout 56 formed in the upper rail 49, the cutout 56 corresponding to the cross section of the eccentric 54.

FIG. 5 shows the connecting mechanism between the bottom metal sheet or plate 47 and the two rails 48 and 49 and also shows the spring-loaded clamping mechanism for clamping the printing plate 14 on the plate cylinder 12. One end of a tension spring 58 is articulatingly attached to respective articulating points 57 which are arranged inside the plate cylinder 12 symmetrically with respect to the plate-cylinder centerline 26, the other end 72 of each of the tension springs 58 holding a pin 61. The pin 61 held by means of a retaining ring 62 and a disk or washer 63, projects through a slot 64 formed in the bottom metal sheet or plate 47, the slot 64 being oriented in circumferential direction of the cylinder, and the pin 61 being secured to the lower rail 48. Another pin 66 is also provided on the lower rail 48 and projects through a slot 67 formed in the upper rail 49, the slot 67 being oriented in longitudinal direction of the cylinder, the other pin 66 being also provided with a disk or washer 63 and a retaining ring 62.

A web or strap 68 formed by a right-angled turned-up edge of the lower rail 48, permits manual actuation of the clamping rail 45 against the spring force of the tension springs 58, for example, to permit replacement of the printing plate 14.

The thus provided clamping rail 45 is thereby movable in longitudinal direction of the cylinder 12 and, in addition, has degrees of freedom permitting an associated diagonal movement with respect to the longitudinal direction of the cylinder 12 as well as a clamping movement in circumferential direction of the cylinder, resulting from forces and movements, respectively, itemized hereinafter, which are transferred to the clamping rail via the bolts 61 and 66 received in the corresponding slots 64 and 67, as well as via the eccentric 54 and the threaded pin 50.

The clamping force of the tension springs 58, together with an associated or accompanying clamping movement oriented in the circumferential direction of the cylinder 12 (slot 64); a transverse or cross-movement oriented in longitudinal direction of the cylinder 12, the cross-movement being triggered by a movement of the eccentric 54 by means of the adjusting lever 55 (slot 67); and a rotational movement (diagonal movement) of the clamping rail 45, the rotational movement being evoked by the threaded pin 50 acting as a rotational axis.

The two tension springs 58 arranged symmetrically with respect to the plate-cylinder centerline 26 are of such dimensions that, because of the spring-forces involved, the perforations in the printing plate 14 cannot be torn out, that furthermore an ideal positioning of the springs 58 on the plate cylinder 12 at high printing speeds is ensured, and that, at the same time compensatory or equalizing expansion of the printing plate 14 can take place during the printing process.

The procedure for setting and adjusting the mounted printing plate 14 is as follows:

Initially, the axially parallel locking of the clamping bar 29 is released via the locking lever 39; then, the rear clamping rail 45 can be adjusted laterally via the eccentric 54 by means of the adjusting lever 55. Accompanying this procedure is a corresponding diagonal orientation or alignment of the clamping bar 29 and the clamping rail 45 because of the degrees of freedom allocated thereto, it being nevertheless always assured that, as a result of the tension springs 58 becoming effective, the printing plate 14 remains clamped over the circumferential surface of the cylinder under constant force. The degrees of freedom in the movement of the rear clamping rail 45 are composed of individual degrees of freedom of component parts, namely the rails 48 and 49 and the clamping rail 45, which are arranged in various planes represented by the broken lines 69, 70 and 71 (FIGS. 3 and 5).

I claim:

1. Clamping device for a printing plate mountable on a plate cylinder of an offset printing machine and having perforations formed at leading and trailing edges thereof, as viewed in direction of sheet travel through the machine, the clamping device comprising clamping bars formed with hooks respectively engageable in the perforations formed in the printing plates, said clamping bars being disposed in a channel formed in the plate cylinder, one of said clamping bars being pivotable about a pivot point diagonally to a longitudinal direction of the plate cylinder, said pivot point being located in the cylinder channel substantially on a center line of the cylinder extending transversely to the longitudinal direction thereof, adjusting means mounted in the cylinder channel for moving another one of said clamping bars in the longitudinal direction of the cylinder, said other clamping bar having additional degrees of freedom of movement accommodating an accompanying diagonal movement with respect to the longitudinal direction of the cylinder and a clamping movement in circumferential direction of the cylinder, clamping units for the leading edge and for the trailing edge of the printing plate, the clamping unit for the leading edge comprising a bottom metal sheet partially covering the channel of the cylinder, a threaded pin carried by said bottom metal sheet substantially on the center line of the cylinder, said threaded pin forming said pivot point for said one clamping bar, said one claping bar being disposed on said bottom metal sheet, and locking means secured to said one clamping bar for locking said clamping bar in axially-parallel position, said locking means comprising a T-shaped locking lever rotatably mounted on a strap of said one clamping bar, said locking lever having a shank engaging in a cutout formed in said bottom metal sheet.

2. Clamping device according to claim 1 wherein said cutout formed in said bottom metal sheet has a narrow section and a broad section, said narrow cutout section being as broad as said shank of said T-shaped locking lever.

3. Clamping device for a printing plate mountable on a plate cylinder of an offset printing machine and having perforations formed at leading and trailing edges thereof, as viewed in direction of sheet travel through the machine, the clamping device comprising clamping bars formed with hooks respectively engageable in the perforations formed in the printing plates, said clamping bars being disposed in a channel formed in the plate cylinder, one of said clamping bars being pivotable about a pivot point diagonally to a longitudinal direction of the plate cylinder, said pivot point being located in the cylinder channel substantially on a center line of the cylinder extending transversely to the longitudinal direction thereof, adjusting means mounted in the cylinder channel for moving another one of said clamping bars in the longitudinal direction of the cylinder, said other clamping bar having additional degrees of freedom of movement accommodating an accompanying diagonal movement with respect to the longitudinal direction of the cylinder and a clamping movement in circumferential direction of the cylinder, and respective clamping units for the leading edge and for the trailing edge of the printing plate, the clamping unit for the trailing edge comprising a bottom metal sheet disposed in and partly covering the cylinder channel, a lower rail and an upper rail thereabove arranged on said bottom metal plate, a metal pin mounted on said upper rail substantially on the center line of the plate cylinder, said metal pin connecting said upper rail with said other clamping bar.

4. Clamping device according to claim 3 wherein both said lower and said upper rails are formed at the undersides thereof with beads as spacers.

5. Clamping device according to claim 4 wherein said beads are mutually spaced at substantially regular intervals.

6. Clamping device according to claim 3 including articulating points disposed within the plate cylinder and arranged symmetrically with respect to the plate cylinder, respective tension springs articulatingly connected at one end thereof, respectively, to said articulating points and holding a respective pin at the other end thereof, said pins, respectively, projecting through a slot formed in said bottom metal sheet and extending in circumferential direction of the cylinder, said pins being fastened to said lower rail, and including another pin engaging said lower rail and projecting through a slot formed in said upper rail and oriented in longitudinal direction of the cylinder.

7. Clamping device according to claim 3 including an eccentric having an adjusting lever and being connected to said lower rail via a threaded pin, said eccentric being disposed substantially at the center line of the plate cylinder, and projecting through a cutout formed in said upper rail for laterally shifting said upper rail.

* * * * *